United States Patent [19]

Brown

[11] 3,942,471

[45] Mar. 9, 1976

[54] GALVANIZING CONTINUOUS ELEMENTS WITH PREVENTION OF CORROSION OF THE PAN

[76] Inventor: William H. Brown, 6200 S. Adams St., Bartonville, Ill. 61607

[22] Filed: Jan. 6, 1975

[21] Appl. No.: 538,962

Related U.S. Application Data

[60] Division of Ser. No. 372,981, June 25, 1973, Pat. No. 3,881,036, which is a continuation-in-part of Ser. No. 265,793, June 23, 1972, abandoned, which is a continuation of Ser. No. 106,442, Jan. 14, 1971, abandoned.

[52] U.S. Cl. ..... 118/420; 118/428; 266/3 R

[51] Int. Cl.[2] ..... B05C 3/12

[58] Field of Search..... 118/419, 420, DIG. 19, 118/429, 428; 427/430–434; 204/28, 206, 207; 266/3 R

[56] References Cited

UNITED STATES PATENTS

| | | | |
|---|---|---|---|
| 1,822,385 | 9/1931 | Watson | 118/420 X |
| 2,077,492 | 4/1937 | Ritzert | 118/420 X |
| 2,527,465 | 10/1950 | Toulmin, Jr. | 118/420 X |

*Primary Examiner*—Kaplan, Morris

*Attorney, Agent, or Firm*—Wegner, Stellman, McCord, Wiles & Wood

[57] ABSTRACT

A method and apparatus for galvanizing an elongated conductive metal element by drawing it through a bath of molten zinc in a conductive pan. Corrosion of the pan is prevented by electrically isolating the element from the pan, except through the zinc, eliminating circulating currents between the element and the pan wall. Quality of the coating, and particularly the uniformity of the thickness of the zinc deposited on the element, is improved by stabilizing the electrical potential in the element and thus the current flowing longitudinally through it. Where multiple elements are drawn in parallel through the bath for simultaneous galvanizing, circulating currents between them are minimized by electrically short circuiting the elements at the incoming and exit ends of the bath.

5 Claims, 12 Drawing Figures

12
14
40
40
20
32
18
24
3.
3.
10d
10c
10b
10a
28
5.
5.
40
40
22

12
B
28
40
22
40
30
4.
F
10
14
16
18
X
32
24
20

40
40
20
22
26
16

50
4.
58
52
46
56
28
40
54
44
42
48
22

THERMOELECTRIC POWERS IN MICROVOLTS PER DEGREE C
-35
-30
-25
-20
-15
-10
-5
0
5
10
15
20
25
30
35
IRON
X
ZINC
0
100
200
300
400
500
600
700
800
900
1000
TEMPERATURE — °C

B
40
28
18
24
40
26
20
40
F
10
X
16

GALVANIZING CONTINUOUS ELEMENTS WITH PREVENTION OF CORROSION OF THE PAN

CROSS REFERENCE TO RELATED APPLICATION

This application is a division of Brown Ser. No. 372,981 filed June 25, 1973, now U.S. Pat. No. 3,881,036 which was a continuation-in-part of Ser. No. 265,793 filed June 23, 1972, now abandoned which was in turn a continuation of Ser. No. 106,442 filed Jan. 14, 1971, now abandoned.

BACKGROUND OF THE INVENTION

1. Field of the Invention

This invention relates to the galvanizing of an elongated electrically conductive element by moving it lengthwise through a molten zinc bath. More particularly, the invention relates to a continuous method for galvanizing steel wire or steel strip by drawing it through a zinc bath in an electrically conductive corrodible pan and to the prevention of corrosion of the pan.

2. Brief Description of the Prior Art

It is a usual practice to galvanize a continuous element, such as a steel wire, by drawing the element from a source through a pan containing molten zinc to a take-up reel. A serious practical problem is the short life of the pan which tends to erode and fail, generally at the incoming end in the vicinity of the point of entry of the wire, usually after an average of only 6 to 8 months of use. Sometimes pans fail in only thirty days.

I believe that pan erosion is caused by an electrochemical reaction resulting from a flow of electric current between the element or wire, the zinc and the pan. The current flow is established by thermoelectric potentials developed along the length of the wire as a result of temperature differentials encountered in the galvanizing operation. Briefly, two types of potentials are present: (1) the potential resulting from the absolute temperature of the wire itself (the Thompson effect), and (2) the potential resulting from the temperature difference between the steel wire and the molten material in which it is immersed (the Seeback effect). The potentials due to the latter effect are of greater significance with respect to pan erosion.

In addition to pan erosion, present continuous galvanizing systems suffer other drawbacks which hamper production and decrease production rates. For example, the coating thickness sometimes varies over a wide range, requiring operation at reduced speeds to minimize the coatings below specifications. Variations of more than 75 percent have occurred on samples taken from a single strand of wire. The variations in coatings increase the zinc consumed, raising the zinc cost by several dollars per ton of wire. Also, at times rejects due to low coating are high.

SUMMARY OF THE INVENTION

This invention provides apparatus for galvanizing an elongated conductive metal element by moving the element lengthwise through a molten zinc bath contained in a corrodible container while blocking the flow of electric currents through the container, thereby inhibiting container corrosion.

In a preferred form, the apparatus is capable of galvanizing steel wire moved through the bath on a continuous basis. The wire is electrically isolated from the zinc container, and the electrical currents through the wire are controlled and stabilized. In the bath container, an incoming sinker is located at approximately the position at which the wire reaches the inversion temperature with the zinc in the bath. Intermediate sinkers, insulated from the container, may be provided between the incoming sinker and the exit sinker at approximately the position where the wires reach maximum potential beyond the inversion temperature within the bath. Two short circuits are provided, one shorting the potential in the wires between incoming sinker at the position of inversion temperature with the wire prior to entry into the bath, and a second which shorts any potential differences in the wires between the sinker and the wiper where the wires leave the bath. Both short circuits are electrically insulated from direct contact with the bath container. A resistive circuit between the wire ahead of the bath and the wire beyond the bath stabilizes the potential therein.

While this invention is susceptible of embodiment in many different forms, there is shown in the drawings and will be described herein in detail, specific embodiments of the invention with the understanding that the invention is not intended to be limited to such embodiments.

DEVELOPMENT OF BACKGROUND MATERIAL AND STUDY OF THE PROBLEMS SOLVED BY THE INVENTION

The present invention is the result of a new approach to solving the problems of pan erosion, dross formation and and uneven coatings in galvanizing wire. Following my belief that pan erosion results from flow of electric currents through the bath and pan, I have studied the patterns of current flow through a galvanizing system.

In a conventional galvanizing operation, the wire is drawn from a source such as a reel through an annealing bath, an acid bath and water rinse to clean the wire and then through a drying oven. From the drying oven the wire is drawn through the galvanizing bath, then in some cases through a furnace at about 540° C. and is then wound on a take-up reel. The method is continuous to the extent that an entire reel of wire is drawn through the complete galvanizing system and is taken up as galvanized wire on the take-up reel. The method continuously processes each reel of wire and during its travel through the system the wire passes across supports and beneath sinkers in the various baths. The supports and sinkers are grounded conductors.

Figures 1, 8, 9, 10, 11, 12:
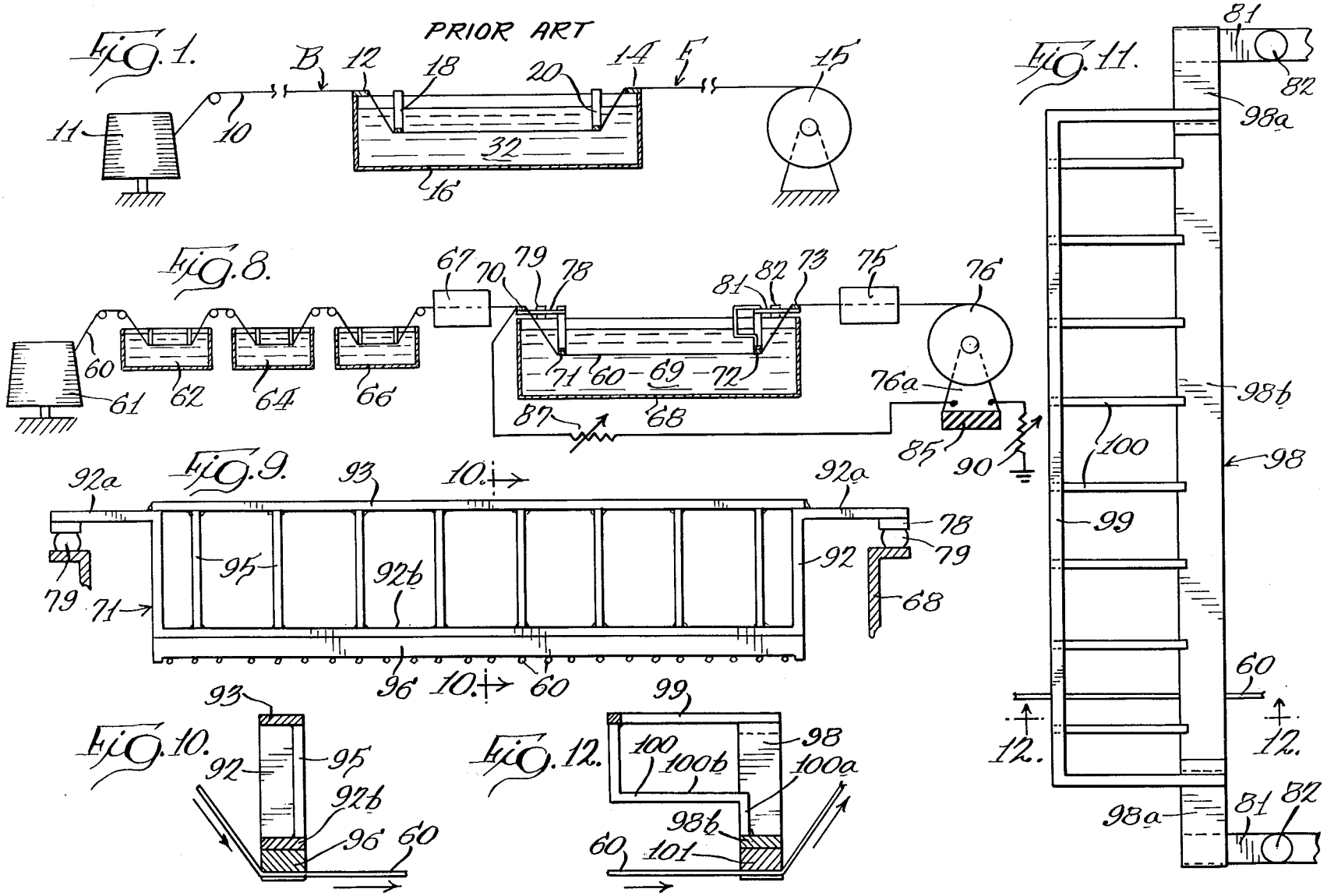
PRIOR ART FIG. 1.
FIG. 1 is a diagrammatic illustration of a prior art galvanizing system.
FIG. 8 is a diagrammatic illustration of a preferred embodiment of the invention.
FIG. 9 is an elevation of the sinker at the incoming end of the bath.
FIG. 10 is a section along line 10—10 of FIG. 9.
FIG. 11 is a plan of the sinker at the exit end of the bath.
FIG. 12 is a section along line 12—12 of FIG. 11.

As shown in FIG. 1, the wire 10 from reel 11 passes over incoming support bar 12 into the galvanizing bath 32 and is kept submerged in the bath by an incoming sinker 18 and an exit sinker 20. The wire passes over a drip bar or wiper 14 to a take-up reel 15. Plural parallel wires may be processed at one time and the separate wires are wound on separate take-up reels. The annealing and cleaning baths are not shown.

The elongated steel wire element 10 is a conductor and in a typical galvanizing apparatus, the wire passes over conductive supports 12 and 14 beneath conductive sinkers 18 and 20 all mounted on the conductive wall or flange of the pan 16.

During the course of the galvanizing operation the temperature of the wire changes radically. Prior to entering the galvanizing bath the wire is at about ambient temperature and in the galvanizing bath the wire is heated to a temperature on the order of 460° C., i.e., the temperature of the molten zinc. (The temperature of a lead annealing bath may be of the order of 710° C.) The temperature variations along the length of the wire during heating within the galvanizing bath establish thermoelectric potentials in the wire. A potential reading taken across a wire between point B at the incoming end of the zinc bath and point F at the exit from the bath, shows that the potential not only varies over a wide range but at times the potential even reverses polarity. I have found that when the exit end of the wire is positive in polarity, a potential in excess of two millivolts is often created and when the incoming end is positive, a potential in excess of 1 millivolt is often created. The potential varies between these limits, constantly changing or drifting up and down.

As an example of the variances in potential, I took potential readings from seven wires being run on a 24 wire frame over a 24 hour period, and the variance in these readings is given below:

| Wire No. | Potential Variance In Millivolts |
|---|---|
| 1 | −.3 to +.3 |
| 4 | −.5 to +.3 |
| 7 | −.3 to +.3 |
| 10 | +.4 to +1.0 |
| 13 | −.7 to +1.3 |
| 16 | −.6 to 0 |
| 19 | −1.0 to +2.2 |

Figure 6:
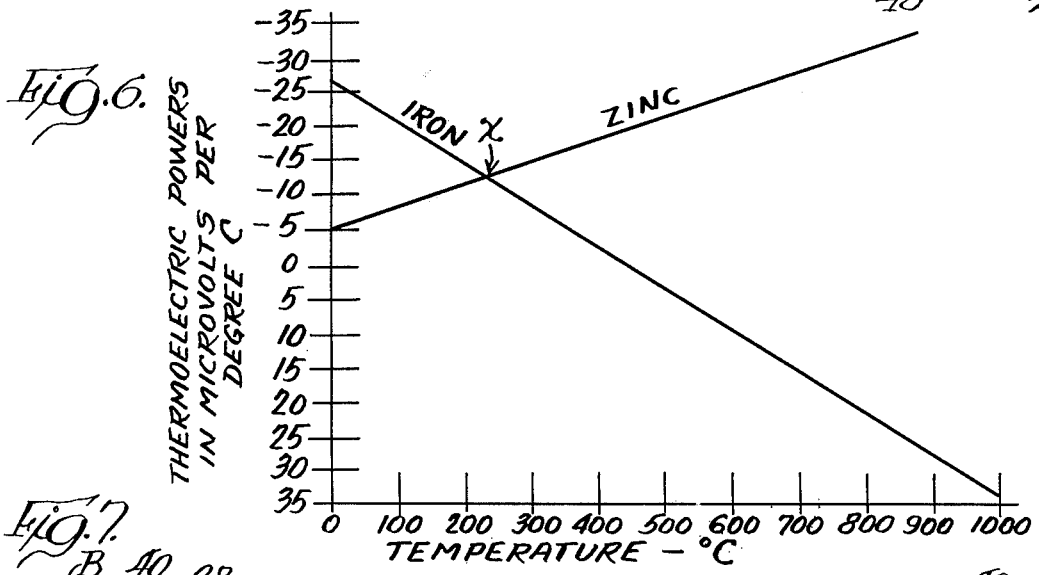
FIG. 6 is a plot of thermoelectric powers useful in understanding the present invention.

The relative magnitudes of the Seeback effect potentials are illustrated in FIG. 6, where experimentally determined thermoelectric powers for iron and zinc are plotted. The voltage which is developed as a result of a temperature difference between the junctions of the two dissimilar metals forming a potential depends on three factors: (1) the metals; (2) the difference of temperature between the junctions; and (3) the mean temperature of the two junctions. In a galvanizing process where a material is submerged in a hot bath of another material there are both a junction and a temperature differential over an extended length and the system is not susceptible of a simple quantitative analysis. However, a consideration of FIG. 6 will aid in a qualitative understanding of the problem. If, for example, there is a circuit of iron and zinc with one junction at 300° C. and the other junction at 400° C., the mean temperature is 350° C. and with reference to FIG. 6, the thermoelectric potential difference is about 11 microvolts per degree. Since the temperature differential is 100° C., the generated voltage is about 1.1 of millivolts. Where the plots for iron and zinc cross at about 237° C., the polarity of the voltage developed in one portion of the system is the opposite of that in the other and the net voltage is the difference between the two. The point of intersection between the two is a neutral temperature or point of inversion for the two materials. If this temperature is the mean of the temperatures of the two junctions, no net voltage is generated.

Considering the inversion temperature of 237° C. in FIG. 6 as point "X" in the galvanizing bath of FIG. 1, the potential "X-B" in the wire increases from point "X" to point "B", or the cold end of the wire. Another potential "X-F" in the wire increases in the opposite direction from point "X" to point "F", or the high temperature end. Thus, in FIG. 2, current flow from point "X" toward both ends of the wire 10. As both the incoming sinker 18 and exit sinker 20 in the system of FIG. 1 are in electrical contact with the pan 16, the following circuit is created: the wire 10 makes contact with the exit sinker 20 and through the exit sinker 20 to the pan 16, then through the pan sides and back to the ends of the incoming sinker 18 through the incoming sinker 18 to the wire 10 and then through the wire 10 into the exit sinker 20. This forms a complete electrical circuit.

Returning to FIG. 6, it will be noted that there is a potential from the wire to the zinc coating when the temperature of the wire is equal to the temperature of the zinc bath, or 460° C. This potential difference is on the order of 20 microvolts. Additionally, when the sinkers have a zinc coating at the point of contact with the wire, the sinkers have an equal potential but the direction of the sinker potential are from the sinkers to the wire. If the exit sinker 20 is coated at the point of contact with the coated wire 10, there are two opposing potentials at this junction.

At the incoming end of the bath, the incoming wire, being at about ambient temperature, lowers the temperature of a thin cover of zinc in contact with the wire for a short time. If it is assumed that the temperatures of the incoming wire and its coating have increased to the neutral inversion point, i.e., 237° C., by the time the wire reaches the incoming coated sinker 18, the potential between the wire and its zinc jacket is zero at that location. But since the sinker 18 is coated at the point of contact of the wire, the potential of the sinker at bath temperature is from the sinker to the wire. The direction of this potential is the same as the "X-B" and "X-F" potentials so that the potential from the incoming sinker is added to the "X-B" and "X-F" potentials. If no current flows in the wire to reduce its potential, the potential from the incoming sinker 18 and the "X-F" potential will remain steady at a maximum value, resulting in a maximum uniform coating. However, the potential generally results in a current flow through the wire to the exit sinker 20 and through the circuit described above.

As indicated above, the "X-B" potential is developed in the incoming wire from a point near the incoming sinker to the point of initial contact of the wire with the molten zinc bath. The current from this potential flows in the wire toward the point of contact with the zinc bath, then through the zinc bath to the incoming end of the pan (or the sides of the pan near the corners at the incoming end), then through the end of the pan to the sides of the pan and back toward the end of the incoming sinker 18. In the absence of any interference, the current would continue to flow through the pan sides and flanges to the ends of the incoming sinker 18 and through the sinker back to the wire, completing the circuit. However, the ends of the incoming sinker normally have a potential equal to or greater than the "X-B" potential because of the "X-F" potential described above. This forces the returning current resulting from the "X-B" potential to flow through the sides of the pan, near the ends of the incoming sinker and the zinc bath, back to the wire. If the resistance in the connection between the flange 22 of pan 16 and one or both ends of the incoming sinker 18 is high, some of the current resulting from the "X-F" potential is forced to flow through the side of the pan 16 near the ends of the incoming sinker 18 and the zinc bath 32 back to the wire 10. It is my belief that any current flowing through the sides of the pan to the bath reduces the life of the pan by causing corrosion or pitting.

The current flowing from the zinc-coated wire 10 to the exit sinker 20 deposits some of the zinc from the wire onto the exit sinker. As the zinc deposit builds up on the exit sinker, the opposing potential from the sinker increases, and so does the contact resistance between the sinker and wires. The increased resistance reduces the current flow and increases the "X-F" potential in the wire, and the thickness of its coating. During the galvanizing operation the potential in the wire varies continuously.

As another consideration, it is often desirable to run a galvanizing unit with several different sizes of wires simultaneously. Also, at times, coating specifications may require running some of the wires at different speeds from other wires of different size. This creates poor conditions for forming uniform coatings because the resistance of different sizes of wire are not equal and the small wires come up to bath temperature and maximum potential in less time than the larger wires. Each of the wires being in contact with the incoming and exit sinkers and having maximum potentials at different positions in the bath causes circulating currents to flow between the different wires through the bath and sinkers. These circulating currents cause potential variations in the different size wires.

Variations in tension of the wires passing through the bath also cause potential variations. When the contact pressure between the wires and the sinkers increases, reducing the resistance of the contacts and increasing the current flow in the circuit, the "X-F" potential and the coating is reduced. Such variations in wire tension can result from variations in amounts of wire on the reels, 11 and 15, the braking effect of the reel brakes which are not always uniform, increased friction due to right angle turns in some of the wires before entering the galvanizing bath, and non-uniform torque on the take-up reel, which often causes the reel to speed up or slow down, thereby changing the tension in the wires.

There are other factors contributing to variations in the potential and the current flow. Since the wire is under tension as it is being moved through the bath, a considerable amount of friction results between the wire and the sinkers and the friction wears through the zinc coating on the sinkers. As the sinker coating wears thin, the opposing potential from exit sinker 20 is reduced. This increases the current flow between the wire and the sinker and as a result of the current flow in the circuit, the potential of the source is reduced. The potential drop in the wire is equal to the current in amperes times the internal resistance of the potential source in ohms and in a galvanizing bath the resistance of the potential source, i.e., the hot wire between the sinkers, is quite high so that a large drop in the "X-F" potential results with a relatively small current flow. Thus, as the current in the circuit increases the "X-F" potential drops and the current will increase until the potential drops to a value at which it cannot force any more current through the resistance of the circuit.

Each of the variable factors discussed above affects the potential generated and the resulting current flow through the wire and between the wire and the molten zinc bath. Thus, these factors contribute to a nonuniform deposit of zinc on the wire.

DESCRIPTION OF THE INVENTION

The form of the invention illustrated in the drawings is especially adapted to galvanizing steel wire which is drawn from a reel through the galvanizing process and coiled on a take-up reel. It is applicable not only to round wire, but to strips and webs of other configurations. Further, it is not essential to the practice of the invention that the material to be galvanized be drawn from a reel or roll. For example, the wire can come directly from a wire-drawing die. Similarly, it is not necessary that the galvanized wire be wound on a take-up reel. It can be cut into short lengths and stacked, for example.

The embodiment of the invention shown in FIGS. 2–5 and 7 has the incoming wire support bar 12 electrically connected to the incoming sinker 18 by a pair of electric contact bars 28 secured to the ends of bar 12 and the ends of the incoming sinker 18. Sinkers 24 and 26 are provided at approximately the position of the maximum value of the "X-F" potential. The ends of exit sinker 20 are secured to contact bars 30 and the exit drip bar or wiper 14 is mounted on the bars 30, assuring electric contact between sinker 20 and wiper 14.

Figure 5:
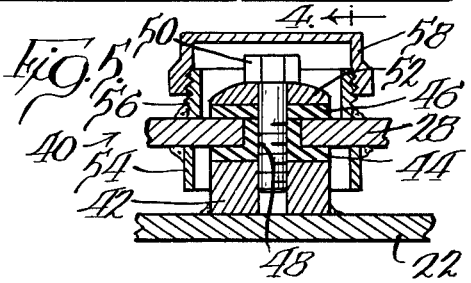
FIG. 5 is an enlarged section along line 5—5 of FIG. 2.

The electric contact bars 28 and 30 and intermediate sinkers 24 and 26 are supported by and secured to the edge flange 22 of pan 16 via electrically insulating mounting means 40. As best seen in FIG. 5, each insulating mounting means 40 includes a nut 42 welded to the top of flange 22. Insulating washers 44 and 46 are positioned above and below contact bar 28 on top of the nut 42 and an intermediate insulating sleeve 48 extends through the bar, as shown. A bolt 50 extends through the washers 44 and 46 and the sleeve 48 and is threaded into the nut 42. Washers 44 and 46, respectively, underlie and overlie the contact bar 28 and, with sleeve 48, completely insulate the bar 28 from the pan 16. Between the head of bolt 50 and the overlying insulating washer 46 there is provided a metal washer 52 which helps clamp washers 44 and 46 more securely against the faces of bar 28. A similar mounting means is provided for bar 30 and for intermediate sinkers 24 and 26 if they are used.

Each insulating mounting means 40 also includes a cover for protecting the insulated connection. Accordingly, a cylindrical skirt 54 is welded to the bottom of bar 28 surrounding the nut 42 and spaced outwardly from the nut 42. The skirt 54 stops short of flange 22 to assure that no electrical contact is made between the protective cover and flange 22. Welded to the top of bar 28 and around the bore is an upstanding cylindrical wall 56. Wall 56 surrounds but does not contact washer 52. The cylindrical wall 56 has external threads which receive a removable cap 58. The removable cap 58 permits easy access to the bolt 50 for tightening or loosening the mounting as desired.

The conductive support or bearing bar 12 being connected at each end to the contact bars 28, a circuit is completed from the incoming wires 10 through the contact bars and the end connections to the ends of the incoming sinker 18 and back to the wire 10. The contact bars 28 provide a low resistance short circuit across the "X-B" potential so that the potential is reduced to a very low value. This very low value results from the low resistance of the short piece of wire included in the circuit and the low average temperature of the short piece of wire. The incoming support and shorting bars and the incoming sinker are all electrically insulated from pan 16 as a unit so that any current resulting from the "X-B" potential is prevented from flowing from the wire through the zinc bath to the pan in either direction.

Similarly, the ends of the exit sinker 20 are mounted on contact bars 30 which are electrically insulated from the pan. This opens the circuit to the pan involving the "X-F" potential and prevents current from flowing through the sides of the pan, then through the zinc bath to the wire. Thus, the circuit described above with regard to "X-F" potential is broken and, since no current flows, the "X-F" potential remains at a higher average value. The higher average "X-F" potential in the wire results in a more uniform coating on the wire than when the exit sinker is electrically connected to the pan.

The intermediate sinkers 24 and 26 further assure the formation of uniform coating on the wires where multiple parallel wires 10*a*, 10*b*, 10*c*, 10*d* . . . of different size are simultaneously processed by electrically connecting the wires together equalizing the potentials and stabilizing the currents through the wire. Sinkers 24 and 26 are insulated from the pan and are spaced a distance from the incoming sinker 18 and are at a point along the bath where the "X-F" potentials in all of the wires have increased to the maximum value. For example, it requires approximately 3-¾ seconds for a No. 9 wire to come up to bath temperature and maximum "X-F" potential and assuming this is the thickest wire to be processed, the intermediate sinkers 24 and 26 can be located at that point in the bath where the wire is at bath temperature when operating at maximum speed to obtain the required coating.

The angle of the wire making contact with the incoming sinker 18, also leaving exit sinker 20, is quite large, resulting in increased contact pressure and low resistance connections. The angle of the wire making contact with sinkers 24 and 26 is very small. This reduces the contact pressure and increases the contact resistance. The addition of sinker 26 forms a parallel circuit reducing the effective contact resistance. This increases the stability of the potential between intermediate sinker 26 and exit sinker 20, and the coating deposited on the wire.

It is believed that during galvanizing of wire using the present invention, the wire entering the molten zinc bath is covered with a thin layer of zinc and the zinc temperature at the wire is reduced to the cooler temperature of the wire. As the wire travels further through the bath the wire temperature increases to bonding temperature and the zinc forms a bond on the wire. In the conventional process, FIG. 1, at times a large current caused by the "X-F" potential flows through the sides of the pan and the zinc to the wire at the beginning of the galvanizing bath. This current deposits a thick jacket of zinc on the wire. The heavy jacket of zinc deters the temperature rise in the wire so that the wire reaches the exit of the bath before its temperature is high enough to form a bond with the zinc, and the wire must be scrapped. The present method eliminates the current flow to the wire at the incoming end of the bath, so that a very thin cover of zinc forms on the wire and the wire heats to bonding temperature in less time. This assures a good bond and leaves a greater percentage of immersion time for coating. The method thereby practically eliminates scrap, and stabilizes the coating time and the coating weight.

A major advantage of the invention is that it increases the life of the galvanizing bath pan. Working with the system has demonstrated that pan life may be increased from a few weeks or months to approximately that of the pans used in hot dip galvanizing. Potential differences do not occur in dipping articles to be galvanized and the pans often last from 12 to 15 years. In one instance a pan was operated as in FIG. 1 for about ten days and it was found that several pits developed in the bottom of the pan up to ¼ inch in depth. (For several years the pans in this sytem had failed every 8 to 10 weeks, with an average of less than 9 weeks.) After modifying the pan in accordance with the invention described above, then using the pan and operating for a period of 4 weeks, it was found that all of the pits had filled up with zinc. The pan was still in operation 1 year later with no failure indicated. The extended life results in savings in material and down time.

Because of the uniform potential at maximum value in the coating area of the present invention, the system can be operated at a faster rate with assurance that the minimum specified coating thickness is formed throughout the length of the wire. This has resulted in a production increase of about 35%. If the heating capacity or the take-up frame limits the speed, shorter pans can be used, resulting in less cost. Operating at maximum speed increases the wire tension and improves the contact between the wires and the sinkers. This improves the voltage control and reduces coating variations. Increasing the operating speed reduces the immersion time and the coating weight. The optimum speed provides the immersion time required to meet the minimum coating specifications.

Formation of dross is also reduced by about one-quarter because of the insulation of the circuits and blocking of current flow through the pan. Dross is believed to result from a current flowing from either the steel wire or a steel pan into the zinc bath, causing disintegration of small particles of the steel. These particles of steel unite with the zinc to form the dross which settles to the bottom of the pan and must be removed frequently. The reduction of dross results in a saving of labor, down time and zinc which would otherwise be consumed in the dross.

Figure 2:
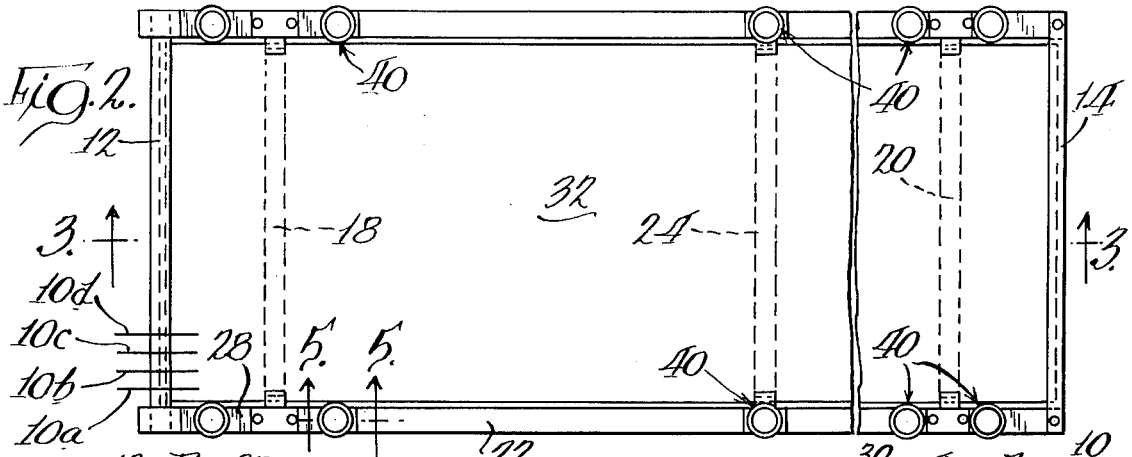
FIG. 2 is a plan view of a molten zinc bath useful in the method of the present invention.
Figure 3:
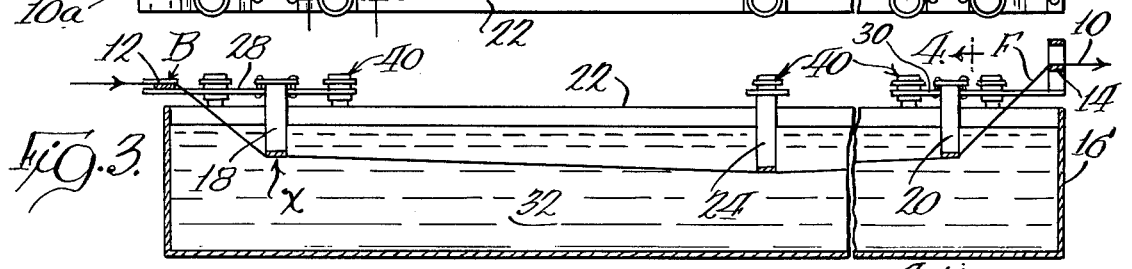
FIG. 3 is a longitudinal section along line 3—3 of FIG. 2.
Figure 4:
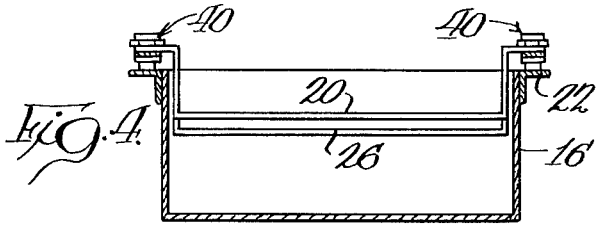
FIG. 4 is a section along line 4—4 of FIG. 3.
Figure 7:
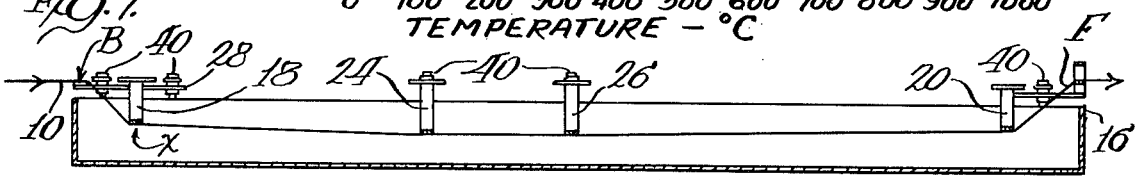
FIG. 7 is a longitudinal section reduced from FIG. 3.

A major disadvantage of the system of FIGS. 2 and 7 is that each wire 10 must be threaded under the intermediate sinkers when the system is started up and in the event a wire should break. This greatly complicates the operation of the galvanizing system. We have found that the intermediate sinkers may be eliminated in the system of FIGS. 8–12.

Referring to FIG. 8, wire 60 from supply reel 61 passes successively through an annealing bath of molten lead 62, and acid bath 64 and a water rinse 66. Following the rinse the wire element passes through a drying oven 67. Wire 60 is submerged in each of the baths by suitable sinkers and is carried between the baths by suitable supports which are not illustrated in detail. Pan 68 for the galvanizing bath 69 of molten zinc is electrically isolated from ground. At the incoming end the wire 60 passes over incoming support 70 and under incoming sinker 71 at the exit end the wire passes under exit sinker 72 and over exit support for wiper 73. Beyond the galvanizing bath, wire 60 passes through oven 75 to a take-up reel 76. Incoming support 70 and sinker 71 are electrically connected by shorting bar 78 and mounted on the pan 68 by an insulator 79. Similarly, wiper 73 and exit sinker 72 are electrically connected through conductive bar 81 and electrically insulated from the pan by insulator 82. Insulators 79 and 82 may be of the construction shown in FIG. 5. The incoming sinker 71 is so located and the speed of the element 60 so controlled that the point of contact between the sinker and the element is substantially at the inversion temperature, as described above. The electrical isolation of the incoming and exit bearings for the element 60 from the pan 68 minimizes electrical currents between the element and the pan, eliminating the currents which are a major source of pan erosion.

The currents flowing longitudinally through the element 60 must be stabilized and controlled, as discussed in connection with the system of FIGS. 2 and 7, to achieve reliable, efficient and uniform coating of the element with zinc. In the preferred embodiment of the invention illustrated in FIG. 8, the ability of the potential generated within the wire element 60 in the zinc bath 69 to cause current to flow longitudinally through the element is minimized by electrically insulating the take-up reel 76 and its supporting frame **76*a* from ground, as by mounting them on a nonconducting base 85**. This prevents a current from circulating longitudinally through the wire back through ground and the supply reel.

The electrical potential of the element is stabilized by a resistive circuit connected from incoming support bar 70, ahead of the galvanizing bath to take-up frame **76*a***, beyond the bath.

The resistance of resistor 87 is selected with the system in operation to achieve a maximum average coating of zinc on the wire. Where, as is common, the system handles plural parallel wires simultaneously, resistor 87 is selected with a full complement of wires moving through the galvanizing bath at maximum operating speed. If the resistance is too small, the desired coating thickness is not achieved. If the resistance is too high, the coating is not uniform and in many instances it is excessive, resulting in a waste of zinc. I have found that the resistance should have a value of less than 2 ohms and is generally less than 1 ohm. The conductors of the resistive circuit 86 are kept physically as short as possible and are of a heavy gauge so that a full range of adjustment by the resistor 87 may be provided.

In the system illustrated in FIG. 8, the wire 60 is annealed in a bath of molten lead before being galvanized. The heating effect of the lead bath also contributes to the potentials in the wire element 60. The container for lead bath 62 is grounded in the usual system. The various sinkers and supports for the element 60 between the lead bath to the zinc bath are insulated from ground to minimize the current paths available through the element.

As an alternate to the electrically insulated take-up reel 76, circulating currents through the wire element 60 may be controlled by insulating supply reel 61 and all intermediate supports for the wire element, ahead of zinc bath 69, from ground. Generally, however, it is less difficult to insulate the take-up reel.

Take-up reel 76 is customarily driven by an electric motor mounted on the take-up frame **76*a*. From a safety standpoint it is desirable that the motor and frame be connected to ground through a relatively low resistance circuit. In the event of a short circuit from a motor winding to the motor frame, this circuit prevents the buildup of a high voltage which might be dangerous to operating personnel. Accordingly, resistor 90** is connected from the frame to ground. This resistor should have sufficient capacity to carry the line current in the event of a motor failure. I have found that a value for the resistance of the order of 2 ohms is satisfactory.

Where multiple parallel elements 60 are handled simultaneously, as is usual in a continuous galvanizing operation, circulating currents between the wires can occur. The principal contributing factors to these currents are differences in the potentials generated within the wires, differences in the resistance of the wires themselves (this is particularly the case where wires of different sizes are handled simultaneously) and differences in contact resistance to the support and sinker bearing surfaces. The circulating currents degrade the quality of the galvanizing coating, impairing the bond of the zinc to the wire and the coating thickness. The sinkers illustrated in FIGS. 9 through 12 minimize the problem of circulating currents.

The incoming sinker 71 has a U-shaped carrier frame 92 with outwardly extending arms **92*a* by which the sinker is mounted from shorting connector 78 in turn carried from pan 68 by insulator 79. Shorting conductor 93 spans the top of frame 92 above zinc bath 69 and is welded thereto at each end. A plurality of conductors 95 are connected between the base portion 92*b* of the frame and conductor 93, joining the two together at a multiplicity of spaced points. Frame 92 and conductors 93 and 95 are preferably made of soft steel. A replaceable bearing member 96 is removably bolted to the underside of frame base 92*b*providing a wearing surface engaged by the wire elements 60. The bearing member may, for exammple, be of cast iron which has a longer life under such conditions than does soft steel. If the bearing plate 96 does not have an intimate low resistance contact with sinker frame base 92*b*, localized currents are set up which lead to rapid erosion of the frame. Accordingly, the undersurface of the base member 92*b* and the upper surface of bearing member 96** are preferably machined so that the contact surface is as smooth as possible.

The multiplicity of conductors 95 spaced along the extent of the sinker frame, and connected with conductor 93, equalizes potentials among the plural elements 60 reducing circulating currents through the wires.

Exit sinker 72 could have the same configuration as incoming sinker 71 if it were spaced a sufficient distance from wiper 73. However, in the interests of minimizing pan length, it is desirable that the exit sinker be physically close to the wiper. As the wire elements 60 leave the galvanizing bath, excess zinc on the wire surfaces builds up and solidifies around the wire. These pieces of zinc are periodically pushed back along the wire into the bath by an operator. If the vertical elements of the exit sinker, as conductors 95 of the incoming sinker, are too close to wiper 73, they interfere with return of the zinc to the bath. Accordingly, the exit sinker preferably has the configuration illustrated in FIGS. 11 and 12.

U-shaped frame 98 has outwardly extending arms 98a carried on conductors 81 insulated from pan 68. Conductor 99 is connected at each end with arms **98*a* above the level of the bath 69 and extends from the arms toward the incoming end of tank 68. This opens the space on the surface of bath 69 between sinker 72 and wiper 73 so that excess zinc may readily be returned to the bath. Plural vertical conductors 100 extend between the base portion 98*b* of the sinker frame and conductor 99. As with the incoming sinker, a cast iron bearing member 101 is removably secured to the base portion 98*b*** of the sinker frame.

Conductors 100 have a vertical offset 100a which spaces the horizontal portion **100*b* thereof above wire element 60 to avoid erosion of the conductors 100 which occurs if there is a poor contact between the wire 60** and the bearing member or between the bearing member and the sinker frame base.

I claim:

1. In an apparatus for galvanizing an elongated element by drawing it through a molten zinc bath contained in an electrically conductive corrodible container and in which the element is passed over conductive supporting members and beneath conductive sinker members which maintain it submerged within the bath, adjacent the incoming and exit ends of the bath, the improvement comprising means electrically isolating said incoming and exit support and sinker members from electrical contact with the bath container other than through the bath means electrically shorting each pair of said incoming and exit support and sinker members, said means being electrically insulated from said container, and a resistive circuit connecting the portion of said element ahead of said bath with the portion of said element beyond said bath whereby to inhibit circulating currents between the element and the pan wall and to stabilize the potential in the element.

2. The galvanizing apparatus of claim 1 in which said pan is insulated from ground and including means insulated from ground for receiving the galvanized element.

3. The galvanizing apparatus of claim 1 for simultaneously galvanizing a plurality of parallel elements, wherein said supports and sinker members are common to all elements, said sinker elements each having a plurality of conductors interconnected along the length thereof to equalize potentials among the elements.

4. The galvanizing apparatus of claim 3 in which each sinker has a conductor supported above and spanning the zinc bath, below which the sinker is suspended, and a plurality of conductors connected generally vertically between said sinker and spanning conductor and spaced along the length thereof.

5. The galvanizing apparatus of claim 1 for simultaneously galvanizing a plurality of parallel elements, wherin said sinkers are elongated and common to all elements, each sinker including a base member and a bearing member removably secured thereto, said base and bearing members having abutting surfaces in intimate electrical contact to minimize circulating currents along the length thereof.

* * * * *